US011134764B2

(12) United States Patent
Xiao et al.

(10) Patent No.: US 11,134,764 B2
(45) Date of Patent: Oct. 5, 2021

(54) HOT IRON AND CURLER WITH BRUSH BRISTLES

(71) Applicant: Farouk Systems, Inc., Houston, TX (US)

(72) Inventors: Yong Xiao, Guangdong (CN); Huan Chang, Guangdong (CN)

(73) Assignee: Farouk Systems, Inc., Houston, TX (US)

( * ) Notice: Subject to any disclaimer, the term of this patent is extended or adjusted under 35 U.S.C. 154(b) by 418 days.

(21) Appl. No.: 15/739,092

(22) PCT Filed: Jul. 11, 2016

(86) PCT No.: PCT/CN2016/089593
§ 371 (c)(1),
(2) Date: Dec. 21, 2017

(87) PCT Pub. No.: WO2017/005221
PCT Pub. Date: Jan. 12, 2017

(65) Prior Publication Data

US 2018/0168310 A1 Jun. 21, 2018

(30) Foreign Application Priority Data

Jul. 9, 2015 (CN) ..... 201520493412.3

(51) Int. Cl.
*A45D 24/10* (2006.01)
*A45D 1/18* (2006.01)
(Continued)

(52) U.S. Cl.
CPC ..... *A45D 1/18* (2013.01); *A46B 9/023* (2013.01); *A46B 15/003* (2013.01)

(58) Field of Classification Search
CPC ... A45D 1/18; A45D 1/04; A45D 1/02; A45D 2/002; A45D 20/48; A45D 24/10; A46B 7/044; A46B 7/04; A46B 7/06
(Continued)

(56) References Cited

U.S. PATENT DOCUMENTS 2,556,691 A * 6/1951 Harshbarger ..... B60S 3/045 15/236.02
3,275,007 A * 9/1966 Thackeray ..... A45D 2/24 132/256
(Continued)

FOREIGN PATENT DOCUMENTS

CN 102665479 9/2012
CN 204796984 11/2015
(Continued)

*Primary Examiner* — Rachel R Steitz
(74) *Attorney, Agent, or Firm* — Blank Rome LLP

(57) ABSTRACT

A hair curler includes a curling iron assembly and comb tooth assembly arranged on the curling iron assembly. The curling iron assembly includes a heating body (12) and a metal sleeve (11) disposed around the heating body (12), the metal sleeve (11) having a linear groove (111) formed in an outer surface of the metal sleeve (11). The comb tooth assembly includes a comb tooth bar (21) disposed within the linear groove (111), a recess (211) formed between a bottom wall of the linear groove and an interior portion of the comb tooth bar (21), and a plurality of pivotal comb teeth (22) having an inserted portion (221) pivotally retained within the recess (211), wherein the pivotal comb teeth (22) are movable relative to the comb tooth bar (21).

14 Claims, 6 Drawing Sheets

(51) Int. Cl.
*A46B 9/02* (2006.01)
*A46B 15/00* (2006.01)

(58) Field of Classification Search
USPC ..... 132/118, 151, 148, 229, 227, 271, 154, 132/152, 142, 126; 15/202, 187, 186
See application file for complete search history.

(56) References Cited

U.S. PATENT DOCUMENTS 4,114,222 A * 9/1978 Serediuk ..... A46B 3/08 132/151
4,623,779 A * 11/1986 Raab ..... A45D 1/18 132/229
4,695,704 A * 9/1987 Andis ..... A45D 1/04 219/222
5,339,840 A * 8/1994 Koppel ..... A01K 13/002 119/625
5,673,710 A * 10/1997 Schaefer ..... A45D 1/18 132/118
5,676,710 A 10/1997 Chedgy
8,602,038 B2 * 12/2013 Choi ..... A45D 1/18 132/271
2005/0109755 A1 * 5/2005 Rachal ..... A45D 2/002 219/222
2010/0163067 A1 * 7/2010 Wynne ..... A46D 1/00 132/162
2014/0102471 A1 * 4/2014 Kaizuka ..... A45D 1/04 132/223
2017/0112271 A1 * 4/2017 Gulamani ..... A46B 7/044
2018/0271247 A1 * 9/2018 Marston ..... A46D 1/00

FOREIGN PATENT DOCUMENTS

DE 3029772 3/1982
DE 3305456 10/1983
DE 3223560 12/1983
DE 3242743 7/1984
EP 0028385 5/1981
GB 2313780 12/1997
JP 3180622 U * 12/2012 ..... A45D 1/18
KR 101314660 B1 * 10/2013
KR 101501719 3/2015
KR 101501719 B1 * 3/2015
WO WO-2015088058 A1 * 6/2015 ..... A45D 1/04
WO WO-2017006676 A1 * 1/2017 ..... A45D 1/00

* cited by examiner

HOT IRON AND CURLER WITH BRUSH BRISTLES

This application is a national stage of International Patent Application No. PCT/CN2016/089593, filed Jul. 11, 2016, which claims the benefit of China Application No. 201520493412.3, filed Jul. 9, 2015, each of which are hereby incorporated by reference in their entirety.

TECHNICAL FIELD

The present disclosure relates to hair styling tools, and particularly relates to a hair curler with swinging comb teeth.

BACKGROUND

With the development of society, hair styling has become a life style of pursuing beauty, and thus various hair styling tools emerge accordingly, e.g. hair straighteners, hair curlers, etc. Hair curlers may have comb teeth (also may be referred to as bristles) or may be provided without comb teeth. Hair curlers with comb teeth generally have comb teeth fixed on a curling iron. During hair curling, hair may be hard to pull or may get stuck when the hair is being pulled, and the hair of a user may be snapped or the scalp of the user may be pained by pulling, so that the comfort of the user is reduced and the hair curler is inconvenient to use.

SUMMARY

In one aspect, embodiments of the present disclosure relate to a hair curler having a curling iron assembly and a comb tooth assembly arranged on the curling iron assembly. The curling iron assembly may include a heating body and a metal sleeve disposed around the heating body, the metal sleeve having a linear groove formed in an outer surface of the metal sleeve. The comb tooth assembly may include a comb tooth bar disposed within the linear groove, a recess formed between a bottom wall of the linear groove and an interior portion of the comb tooth bar, and a plurality of pivotable comb teeth having an inserted portion pivotally retained within the recess, wherein the pivotable comb teeth are movable relative to the comb tooth bar.

In another aspect, embodiments of the present disclosure relate to a hair curler having a curling iron assembly, a plurality of openings formed in an outer surface of the curling iron assembly, the openings extending to a recess formed a depth beneath the outer surface, and a plurality of comb teeth extending outwardly from the curling iron assembly. The curling iron assembly may include a metal sleeve disposed around a heating body. The comb teeth may include a first type of comb tooth having a first type inserted portion retained within the recess and a second type of comb tooth having a second type inserted portion, the second type inserted portion retained within and having a mating shape with the recess.

In yet another aspect, embodiments of the present disclosure relate to methods that include assembling a curling iron assembly including a metal sleeve disposed around a heating body and pivotally mounting a comb tooth to the curling iron assembly. Pivotally mounting may include forming at least one recess a depth below an outer surface of the curling iron assembly and at least one opening extending from the outer surface to the at least one recess and inserting an inserted portion of the comb tooth through the opening and into the recess. The comb tooth may have an arcuate cross sectional profile of the inserted portion different from an interior cross sectional profile of the recess in which the inserted portion is disposed and an exposed portion extending outwardly from the inserted portion, wherein the inserted portion of the comb tooth is pivotally retained in the recess.

Other aspects of the invention will be apparent from the following description and the appended claims.

DETAILED DESCRIPTION

Figure 1:
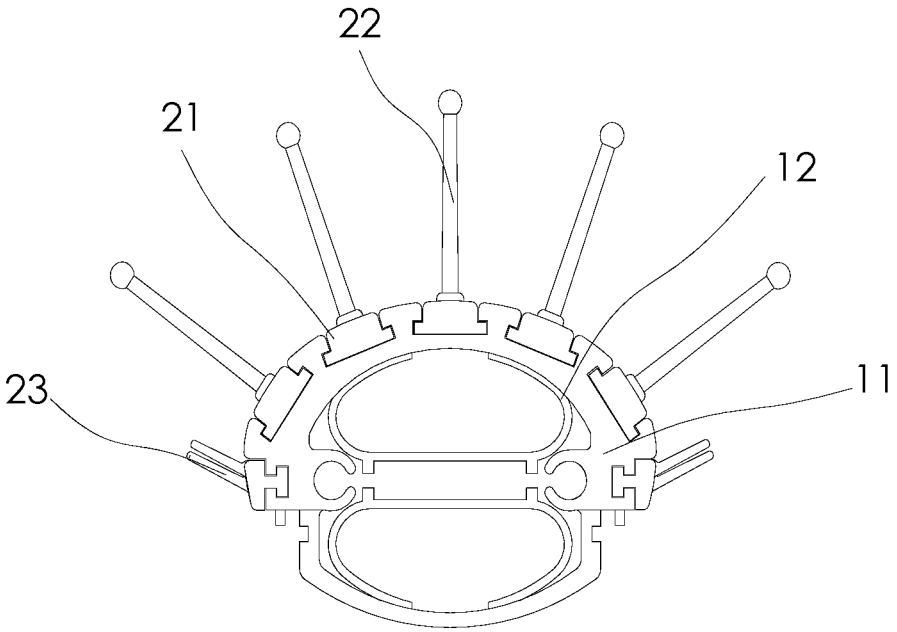
FIG. 1 is a structural schematic diagram of a hair curler according to embodiments of the present disclosure.

Embodiments of the present disclosure include providing a hair curler with swinging or pivotable comb teeth, where the pivotal comb teeth are movable relative to the hair curler, so that the hair curler is more convenient to use and simple in structure.

According to some embodiments, a hair curler with pivotal comb teeth may include a hand grip and a curling iron assembly fixed at a front end of the hand grip, wherein a comb tooth assembly is arranged on the curling iron assembly, the comb tooth assembly having a plurality of comb tooth bars arranged in a circumferential array around a central axis of the curling iron assembly and a plurality of comb teeth pivotally retained to the comb tooth bars, each of the comb tooth bars being provided, along a length direction thereof, with a plurality of recesses, wherein the plurality of comb teeth are inserted into the recesses in a one-to-one correspondence manner and are in sliding fit with the recesses. The parts of the comb teeth inserted into the recesses form inserted portions in sliding fit with bottom walls of the recesses, where the cross sections of the inserted portions may be semicircular or other arcuate shape.

The curling iron assembly may include a metal sleeve and a heating body fixed in the metal sleeve, wherein the plurality of comb tooth bars are arranged in a circumferential array around a central axis of the metal sleeve. A plurality of comb tooth grooves arranged in a circumferential array around the central axis of the metal sleeve and used for mounting the comb tooth bars may be formed in an outer surface of the metal sleeve. In some embodiments, a comb tooth assembly may further include side comb teeth arranged on two opposite sides of the metal sleeve.

According to some embodiments of the present disclosure, a hair curler may include a curling iron assembly and a comb tooth assembly arranged on the curling iron assembly. The curling iron assembly may include a heating body and a metal sleeve disposed around the heating body, the metal sleeve having at least one linear groove formed in an outer surface of the metal sleeve. The comb tooth assembly may include a comb tooth bar disposed within one of the linear grooves, a recess formed between a bottom wall of the linear groove and an interior portion of the comb tooth bar, and a pivotable comb tooth having an inserted portion pivotally retained within the recess, wherein the pivotable comb tooth is movable relative to the comb tooth bar.

In some embodiments, a hair curler may include a heating body, a metal sleeve disposed around the heating body, the metal sleeve having a plurality of linear grooves formed in an outer surface of the metal sleeve, a comb tooth bar disposed in at least one of the linear grooves, wherein a recess is formed between a bottom wall of the linear groove and an interior portion of the comb tooth bar, and a plurality of comb teeth extending outwardly from the metal sleeve. The comb teeth may include a first type of comb tooth having a first type inserted portion retained within the recess and a second type of comb tooth having a second type inserted portion, the second type inserted portion retained within and having a mating shape with the linear groove.

Embodiments of the present disclosure will be further described below in conjunction with the accompanying drawings and specific embodiments.

A hair curler with pivotal comb teeth as shown in FIGS. 1-5 may include a hand grip and a curling iron assembly fixed at a front end of the hand grip. A hand grip (also may be referred to as a handle) may be fixed to a curling iron assembly in an end-to-end configuration, such that when the hair curler is being used, the hand grip may be held by a user's hand and hair may be curled through the curling iron assembly to prevent scalding the hand.

One or more comb tooth assemblies may be arranged on a curling iron assembly, so that the hair curler can function to comb the hair of a user when the hair is being curled. As shown in FIG. 1-5, a comb tooth assembly may include one or more comb tooth bars 21 and a plurality of comb teeth 22 inserted through openings 24 of the comb tooth bars 21, such that inserted portions 221 of the comb teeth 22 are disposed in an interior portion 26 of the comb tooth bars 21. The plurality of comb tooth bars 21 may be inserted into linear grooves 111 formed in an outer surface 14 of the metal sleeve 11 and arranged in a circumferential array around a central axis of the curling iron assembly. The space defined between the interior portion 26 of each of the comb tooth bars 21 and a bottom wall 113 of the linear grooves 111 is referred to herein as a recess 211. A plurality of recesses 211 may be formed along a length direction of the comb tooth bars 21. Comb teeth 22 may be inserted into the recesses 211 in a one-to-one correspondence manner and are in sliding fit with the recesses 211, or in other words, are pivotably retained to the recesses 221, such that the comb teeth 22 can move relative to the comb tooth bars 21. Pivotably mounted comb teeth 22 may have certain flexibility to move about their connection points, and thereby may effectively mitigate the situations where hair is snapped, strained or the like during the hair curling process, and also, may play a role of guiding and smoothening the hair, so that the hair curling effect is better. The arrangement of comb tooth bars 21 in a circumferential array around the central axis of the curling iron assembly may correspond to the winding direction of the hair of a user on the curling iron assembly during the hair curling process, where the comb tooth assembly arranged in such direction may enable the comb teeth 22 to comb the hair wound on the curling iron assembly, so that the hair curling effect is better. For example, the linear grooves 111 and inserted comb tooth bars 21 may extend a length along the metal sleeve 11 in a direction parallel with a central axis of the curling iron assembly, and may be equally or unequally spaced apart along the outer perimeter or circumference of the metal sleeve. In some embodiments, such as shown in FIGS. 1-5, linear grooves 111 may be spaced circumferentially around a portion of the metal sleeve outer surface 14 extending less than an entire perimeter of the metal sleeve 11.

Pivotable comb teeth 22 may be pivotably mounted to a comb tooth bar 21 by inserting a comb tooth 22 through an opening 24 formed in the comb tooth bar 21, where the part of the comb tooth 22 inserted into an interior portion of the comb tooth bar 21 (or into the recess 211 between a comb tooth bar 21 assembled in a linear groove 111) may be referred to as an inserted portion 221. An exposed portion of the pivotable comb tooth 22 extends outwardly from the comb tooth bar 21 (and the metal sleeve 11 to which the comb tooth bar 21 is assembled). As shown, an exposed portion of a pivotable comb tooth 22 may include a shaft 25 extending outwardly from the inserted portion 221 to a ball tip 27 at an axial end of the comb tooth 22 opposite the inserted portion, where the ball tip 27 may have a diameter greater than a diameter of the shaft 25.

Figure 3:
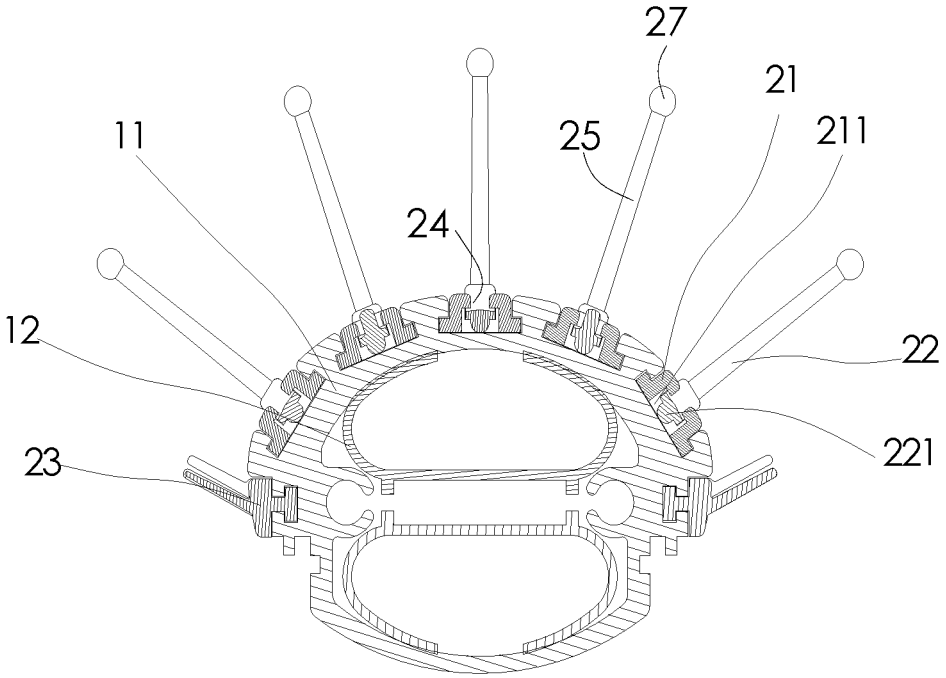
FIG. 3 is a sectional structural schematic diagram of a hair curler according to embodiments of the present disclosure.

An inserted portion 221 of a pivotable comb tooth is in sliding fit with a bottom wall of the recess 211, or in other words, the inserted portion 221 may slide or move relative to the bottom wall of the recess 211, to pivotally mount the pivotable comb tooth 22 to the comb tooth bar 21. To provide a sliding fit between an inserted portion and a recess, the inserted portion may have a volume less than the volume of the recess, such that the inserted portion may move within recess. In some embodiments, a sliding fit between an inserted portion and a recess may be provided when the inserted portion has a cross sectional profile shape different from the cross sectional profile shape of the recess, when viewed along a shared cross sectional profile. For example, in some embodiments, an inserted portion having a semicircular cross section profile may be disposed in a recess having a polygonal cross sectional profile. In some embodiments, an inserted portion may have an arcuate cross sectional profile pivotal about the bottom wall of linear groove (forming the bottom wall of the recess). For example, as shown in FIG. 3, a cross sectional profile shape of the inserted portion 221 may include a semicircular portion so as to facilitate smoother sliding of the inserted portion 221 along the bottom wall in the recess 211, thereby improving the swinging effect of the pivotable comb teeth 22 relative to the comb tooth bar 21. However, in other embodiments, a sliding fit between an inserted portion and a recess may also be achieved when the cross sectional profile of the inserted portion has other shapes, including, for example, square, elliptical or conical.

Figure 2:
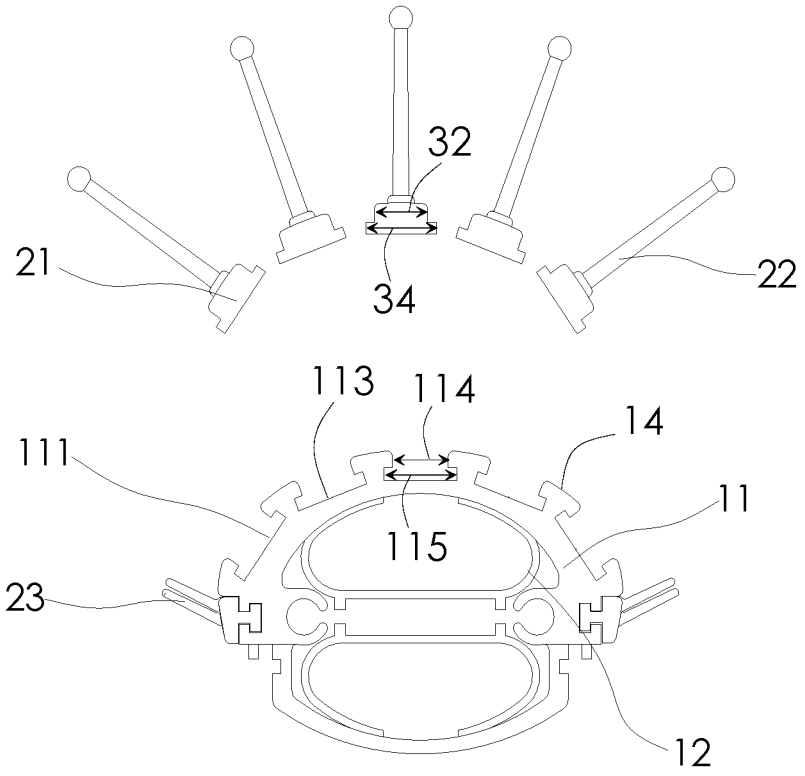
FIG. 2 is an exploded structural schematic diagram of a disassembled hair curler according to embodiments of the present disclosure.

As shown in FIG. 3, an inserted portion 221 may be retained to a comb tooth bar 21 while also being pivotal relative to the comb tooth bar 21 using a variable diameter configuration, where a relatively smaller inner diameter of a comb tooth bar opening 24 may inhibit a relatively larger outer diameter of the inserted portion 221 from being pulled out of the recess 211. The comb tooth bar 21 may similarly be retained within a linear groove 111, although without being pivotal relative to the linear groove, using a variable diameter configuration. For example, as shown in FIGS. 1-3, a linear groove 111 may have an interior cross sectional profile having a first inner diameter 114 smaller than a second inner diameter 115, the first inner diameter 114 proximate the outer surface 14 of the metal sleeve 11 and the second inner diameter 115 proximate the bottom wall 113. The comb tooth bar 21 may have a corresponding outer cross sectional profile, including a first outer diameter 32 smaller than a second outer diameter 34, where the portion of the outer profile having the first outer diameter 32 may fit within the first inner diameter 114 of the linear groove 111, and the portion of the outer profile having the second outer diameter 34 may fit within the second inner diameter 115 of the linear groove 111 when the comb tooth bar 21 is slid into the linear groove 111. Using such configuration, the portion of the comb tooth bar 21 having the second outer diameter 34 may be retained within the linear groove 111 by the portion of the linear groove 111 having the first inner diameter 114.

A curling iron assembly may include a metal sleeve 11 and a heating body 12, wherein the heating body 12 is fixed in the metal sleeve 11 to heat the metal sleeve 11 and provide the heat required for hair curling, so that the hair curling effect is better. One or more comb tooth bars 21 may be arranged in a circumferential array around a central axis of the metal sleeve 11. The metal sleeve 11 may be formed of aluminum or an aluminum alloy having heat conduction properties suitable for heating the outer surface 14 of the metal sleeve 11 to temperatures utilized in curling hair.

Further, a plurality of linear grooves 111 may be formed in an outer surface of the metal sleeve 11, where each linear groove 111 may extend linearly along a length of the metal sleeve 11 substantially parallel with a central axis of the curling iron assembly. The comb tooth bars 21 are mounted in the linear grooves 111 in a one-to-one correspondence manner. The linear grooves 111, and thus comb tooth bars 21 disposed in the linear grooves 111, may be arranged in a circumferential array around the central axis of the metal sleeve 11.

According to embodiments of the present disclosure, a comb tooth assembly may include two types of comb teeth, a first type of comb tooth (pivotable comb teeth) with a first type inserted portion pivotably retained within a recess formed between a comb tooth bar and a linear groove and a second type of comb tooth having a second type inserted portion retained within and having a mating shape with a linear groove. The second type of comb tooth having a second type inserted portion may be referred to as a fixed comb tooth, as the mating shape of the second type inserted portion with the linear groove in which it is disposed may fix the second type comb tooth in an outwardly extending direction, as opposed to the pivotal retention of pivotable comb teeth to a comb tooth bar. Fixed comb teeth may be disposed in and retained directly to one or more linear grooves separate from linear grooves retaining comb tooth bars and pivotal comb teeth. For example, according to some embodiments, a plurality of pivotal comb teeth may be pivotally retained to one or more comb tooth bars disposed in a one-to-one configuration in one or more linear grooves formed in a metal sleeve. At least one additional linear groove may be formed in the outer surface of the metal sleeve, where at least one fixed comb tooth may be retained directly to the at least one additional linear groove. Additional linear grooves may be formed in various locations along the metal sleeve to retain fixed comb teeth, for example, on opposite sides of a metal sleeve or in some embodiments, a single additional linear groove may be formed in a metal sleeve to retain fixed comb teeth.

In some embodiments, linear grooves formed in an outer surface of a metal sleeve may include intermediate linear grooves retaining a first type of comb teeth spaced circumferentially between two border linear grooves retaining a second type of comb teeth. For example, one or more intermediate linear grooves may have comb tooth bars pivotally retaining pivotable comb teeth thereto, while the border linear grooves may retain fixed comb teeth.

For example, as shown in FIGS. 1-3, a comb tooth assembly disposed on a curling iron assembly may include fixed comb teeth 23 in addition to pivotable comb teeth 22, where the fixed comb teeth 23 are arranged on two opposite sides of the metal sleeve 11. The fixed comb teeth 23 on the two sides of the metal sleeve 11 may provide a certain hair grabbing effect, so that the required strength of a user's arm can be reduced and the fatigue of the user can be relieved. In the embodiment shown, comb tooth bars 21 are disposed in intermediate linear grooves 111 arranged around the central axis of the metal sleeve 11 and circumferentially spaced between two border linear grooves 111 retaining the two rows of fixed comb teeth 23.

Methods of forming a hair curler according to embodiments of the present disclosure may include assembling a curling iron assembly, the curling iron assembly having a metal sleeve disposed around a heating body, and pivotally mounting a comb tooth to the curling iron assembly, where pivotally mounting includes forming at least one recess a depth below an outer surface of the curling iron assembly and at least one opening extending from the outer surface to the at least one recess and inserting an inserted portion of the comb tooth through the opening and into the recess. The comb tooth may include an arcuate cross sectional profile of the inserted portion different from an interior cross sectional profile of the recess in which the inserted portion is disposed and an exposed portion extending outwardly from the inserted portion, wherein the inserted portion of the comb tooth is pivotally retained in the recess. A recess may be formed prior to assembling a pivotal comb tooth assembly (e.g., by machining the recess within the metal sleeve or molding the metal sleeve to have a recess therein), or a recess may be formed after assembling a pivotal comb tooth assembly, where one or more pivotal comb teeth may be assembled to a comb tooth bar and the recess is formed via insertion of the pivotal comb tooth assembly to a linear groove (between the interior portion of the comb tooth bar and the bottom wall of the linear groove).

For example, according to some embodiments of the present disclosure, a hair curler may be formed by assembling a curling iron assembly, assembling a comb tooth assembly, and attaching the comb tooth assembly to the curling iron assembly. The curling iron assembly may include a heating body and a metal sleeve disposed around the heating body. At least one comb tooth may be pivotally mounted to the metal sleeve by assembling a comb tooth assembly having a comb tooth bar and at least one comb tooth inserted there through. The curling iron assembly may be attached to a hand grip, for example, using mechanical attachment mechanisms such as interlocking features, screws or threaded connections between the curling iron assembly and the hand grip. In some embodiments, a hand grip may be formed integrally with a curling iron assembly. Hand grips may be covered or formed of a plastic or other thermally insulating material to prevent the user from being burned while holding the hair curler.

Pivotally mounting a comb tooth to a metal sleeve of a curling iron assembly may include providing a comb tooth bar having at least one opening to an interior portion of the comb tooth bar and inserting a pivotal comb tooth through the opening, where the pivotal comb tooth has an inserted portion disposed within the interior portion of the comb tooth bar and an exposed portion extending outwardly from the comb tooth bar. The comb tooth assembly may be slid into a first linear groove formed in an outer surface of the metal sleeve to form a recess between the interior portion of the comb tooth bar and a bottom wall of the first linear groove, such that the inserted portion of the pivotal comb tooth is pivotally retained in the recess. An inserted portion of a pivotal comb tooth may be pivotal or movable within the recess, for example, by providing the inserted portion with an arcuate cross sectional profile or by providing the inserted portion with a cross sectional profile smaller than that of the recess, such that a gap is formed between the inserted portion and the inner walls of the recess sufficient for movement of the inserted portion relative to the recess.

Figure 4:
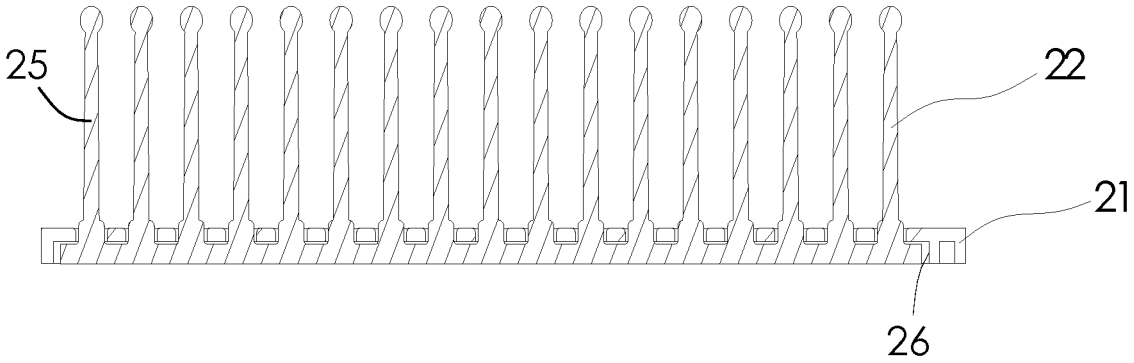
FIG. 4 is a structural schematic diagram of a comb tooth assembly of according to embodiments of the present disclosure.
Figure 5:
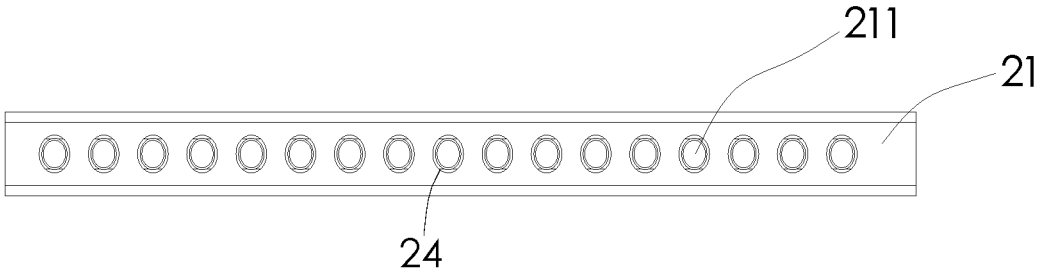
FIG. 5 is a structural schematic diagram of a comb tooth bar of according to embodiments of the present disclosure.

As shown in FIGS. 4 and 5, a plurality of pivotal comb teeth 22 may have inserted portions integrally formed together, where the exposed portions or shafts 25 extend from the formed-together inserted portions and are spaced apart corresponding to the spacing of the openings 24 formed in the comb tooth bar 21.

As shown FIGS. 3 and 4 by the cross sectional views of the integrally formed-together inserted portions of the plurality of pivotal comb teeth 22, integrally formed-together inserted portions may have a lengthwise cross sectional profile that extends a length of the comb tooth bar 21. The lengthwise cross sectional profile may extend a length past two or more openings 24 formed in the comb tooth bar 21 and up to the entire length of the interior portion 26 in the comb tooth bar 21, such as shown in FIG. 4. In some embodiments, a length of integrally formed-together inserted portions may extend a distance equal to or greater than N times the diameter of an opening formed in a comb tooth bar plus (N−1) times the distance of a spacing between adjacent openings, where N may range from 2 to the number of openings formed in a comb tooth bar (e.g., up to 10, up to 15, up to 20 or more). As shown in FIG. 3, the widthwise cross sectional profile may be smaller than and have a different shape than a recess 211 formed between the interior portion of the comb tooth bar 21 and a bottom wall of the linear groove in which the comb tooth bar 21 is disposed.

According to embodiments of the present disclosure, integrally formed-together inserted portions of a plurality of pivotal comb teeth may have a lengthwise profile corresponding in shape with the lengthwise profile a recess formed between the comb tooth bar interior portion and linear groove bottom wall along at least a portion of the length of the recess and may have a widthwise profile smaller than and/or with a different shape than the widthwise profile of the recess. By providing an inserted portion of one or more pivotal comb teeth with a lengthwise profile corresponding in shape with the lengthwise profile of a recess, along at least a portion of the length of the recess, and providing the inserted portion with a widthwise profile smaller than and/or having a shape different than the widthwise profile of the recess, the pivotal comb tooth/teeth may pivot or move relative to the recess in a widthwise direction while remaining relatively fixed in the lengthwise direction.

In some embodiments, pivotal comb teeth may be separate pieces inserted through comb tooth bar openings in a side-by-side configuration, where the inserted portions of the pivotal comb teeth may abut adjacent inserted portions or may be spaced apart from adjacent inserted portions.

According to embodiments of the present disclosure, one or more inserted portions, whether integrally formed together or separately inserted, may have a lengthwise profile with a bottom side corresponding in shape with a bottom wall of the recess in which the inserted portions is disposed and a widthwise profile with the bottom side having a different shape than the bottom wall of the recess. For example, as shown in FIGS. 3 and 4, an inserted portion of a pivotal comb tooth 22 is inserted into a recess 221 having a planar bottom wall (when viewed along both the widthwise cross sectional profile, FIG. 3, and the lengthwise cross sectional profile, FIG. 4), where a bottom side of the inserted portion has a non-planar shape along its widthwise profile and is planar along its lengthwise profile. In such embodiments, the pivotal comb tooth may pivot or move in the widthwise direction relative to the recess, while remaining relatively fixed in the lengthwise direction.

Methods of the present disclosure may further include retaining two or more different types of comb teeth to a curling iron assembly. For example, in some embodiments, one or more comb tooth assemblies including pivotal comb teeth inserted in a comb tooth bar may be mounted to a curling iron assembly and one or more second type of comb teeth may be mounted to the curling iron assembly. A second type of comb tooth may include comb teeth having a different size and/or shape than a first type of comb tooth mounted to a curling iron assembly. For example, one type of comb tooth may include pivotal comb teeth (having an inserted portion with a shape that is pivotal relative to a linear groove formed in the curling iron assembly and in which the pivotal comb tooth is retained), and another type of comb tooth may include fixed comb teeth that are fixed or relatively non-movable relative to the linear groove in which the fixed comb teeth are retained. As discussed above, fixed comb teeth may have an inserted portion with an outer cross sectional profile mating with an interior cross sectional profile of the linear groove in which the fixed comb teeth are disposed to fix the inserted portion in a non-movable position relative to the linear groove.

In some embodiments, different types of comb teeth may include different retention configurations and/or different sizes. For example, in some embodiments, hair curlers may have a first type of comb teeth with an exposed portion having a first height extending from an outer surface of the curling iron assembly and a second type of comb teeth with an exposed portion having a second height extending from the outer surface of the curling iron assembly, where the first height is greater than the second height. In some embodiments, a first type of comb teeth may have a different exposed portion height and a different retention configuration (e.g., pivotal or fixed) than a second type of comb teeth.

Figure 6:
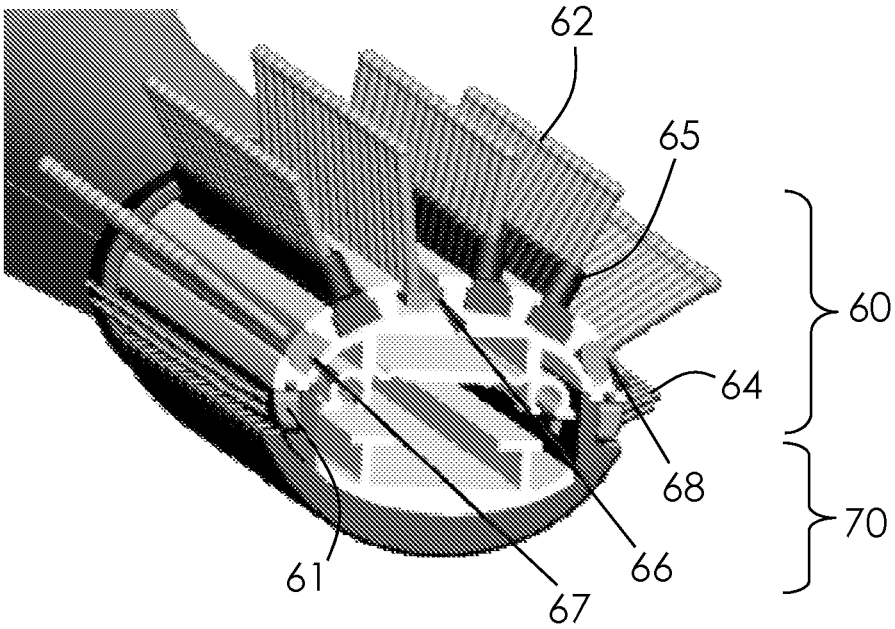
FIG. 6 shows a cross sectional view of a hair curler according to embodiments of the present disclosure.
Figure 7:
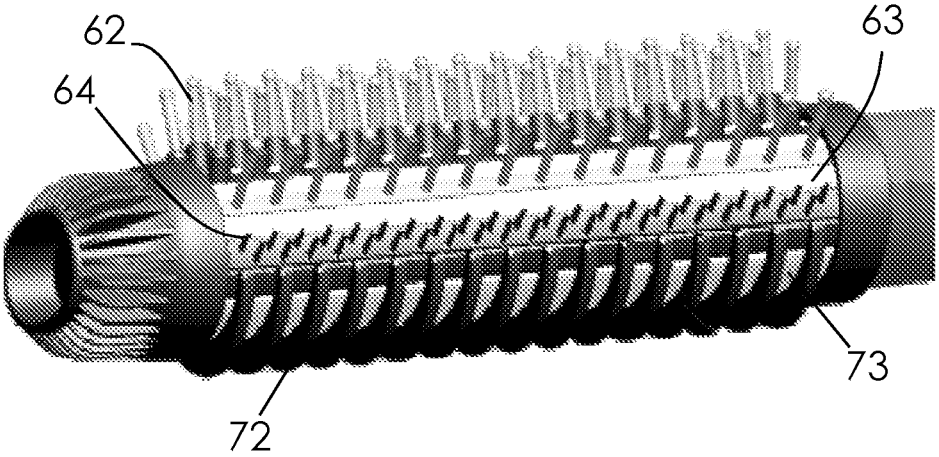
FIG. 7 shows a perspective view of the hair curler shown in FIG. 6.

Referring now to FIGS. 6 and 7, an example of a hair curler according to embodiments of the present disclosure is shown having a first type of comb teeth 62 and a second type of comb teeth 64 disposed circumferentially around a bristled portion 61 of the hair curler. The bristled portion 60 extends partially around the circumference of the hair curler and an unbristled portion 70 (which does not include comb teeth) extends around the remaining circumference of the hair curler. As used herein, terms relating to the circumference of a hair curler (e.g., circumferentially) may refer to the distance around the outer surface of a hair curler having a circle, oval, elliptical, or other rounded cross sectional shape. For example, a hair curler having an elliptical cross sectional shape is shown in FIG. 6, and a hair curler having a generally rounded cross sectional shape is shown in FIG. 3. Embodiments of the present disclosure may include hair curlers with other cross sectional shapes, such as a circle, an elliptical shape, or other rounded shapes having varying radii of curvature.

The unbristled portion 70 includes a metal heating plate 73 and a plurality of heating guards 72 extending circumferentially around the unbristled portion 70 and over the metal heating plate 73. The heating guards 72 are axially spaced apart along a length of the curling iron assembly portion of the hair curler. Further, the heating guards 72 extend a height radially outward from the outer surface of the hair curler less than the height of the comb teeth 62, 64. According to embodiments of the present disclosure, heating guards may extend a height from the outer surface of a hair curler that is less than some or all of the comb teeth on the hair curler. Further, heating guards may have a width that is greater than, equal to, or less than a diameter of a comb tooth. In the embodiment shown in FIG. 7, the heating guards 72 have a width that is greater than the diameter of the comb teeth 62, 64, but less than the axial spacing between adjacent heating guards. According to embodiments of the present disclosure, axial spacing between adjacent heating guards may be greater than 2 times, greater than 4 times, or greater than 6 times the width of the heating guards. By providing axially spaced apart heating guards around the unbristled portion of a hair curler, a user's head may be protected from the heat of the metal heating plate while also allowing sufficient heating space between the heating guards to heat the user's hair.

The bristled portion 60 includes a plurality of linear grooves 66 formed along a length of the outer surface 63 of the hair curler. In the embodiment shown, the first type of comb teeth 62 are pivotal comb teeth that are pivotally retained to linear grooves 66 using a comb tooth bar 67. A comb tooth bar 67 may be inserted into a linear groove 66, where a recess is formed between the bottom wall of the linear groove and an interior portion of the comb tooth bar. An inserted portion 68 of the pivotal comb teeth 62 may be disposed within the recess and may be configured (e.g., in size or shape) to pivot or move relative to the recess.

In the embodiment shown, the second type of comb teeth 64 are fixed comb teeth that are fixedly retained to linear grooves 66 via an integrally formed-together inserted portion having a corresponding or mating shape with the linear grooves. In other words, a plurality of fixed comb teeth 64 may have inserted portions 61 integrally formed together in a linear configuration, where the linear configuration of the integrally formed together inserted portions fits within and mates with a linear groove 66. The fixed comb teeth 64 may be arranged in one or more linear rows along the integrally formed-together inserted portions, or may be arranged in a non-linear pattern. As shown, the fixed comb teeth 64 may be arranged at the circumferential edges of the bristled portion 60, where the pivotal comb teeth 62 are pivotally retained to intermediate linear grooves 66, and the fixed comb teeth 64 are fixedly retained to bordering linear grooves 66. In other words, the intermediate linear grooves (and retained pivotal comb teeth 62) are spaced circumferentially between two bordering linear grooves 66 (and retained fixed comb teeth 64).

Further, in the embodiment shown, the fixed comb teeth 64 have a height extending from the outer surface of the hair curler that is less than the pivotal comb teeth height. By providing shorter fixed comb teeth 64 along the circumferential edges of the bristled portion 60 (bordering intermediate rows of relatively taller pivotal comb teeth 62), hair may more easily be held or gripped by the bristled portion 60 of the hair curler, reducing incidences of hair sliding out during use. According to embodiments of the present disclosure, a hair curler having both pivotal and fixed comb teeth may include pivotal comb teeth with a height extending from the outer surface of a hair curler that is greater than 1.5 times, greater than 2 times, or greater than 2.5 times the height of fixed comb teeth extending from the outer surface of the hair curler. In some embodiments, pivotal comb teeth on a hair curler may extend a height from the outer surface of the hair curler that is greater than the height of fixed comb teeth extending from the outer surface of the hair curler by at least 10 mm, at least 12 mm, or at least 14 mm.

A comb tooth bar 67 may have prongs 65 extending radially outward therefrom, in a direction radially outward from the linear groove 66 in which the comb tooth bar 67 is disposed. A prong 65 may have a tubular body through which a comb tooth extends when assembled together. In the embodiment shown, prongs 65 may be disposed around the shafts of the pivotal comb teeth 62, where the exposed portions of the pivotal comb teeth have a length greater than the length of pivotal comb teeth disposed within the prongs 65. In other words, pivotal comb teeth 65 include a covered portion (portions disposed within the prongs 65 and within the comb tooth bars 67) and an exposed portion, where the exposed portion is longer than the covered portion. In some embodiments, pivotal comb teeth may have an exposed portion length greater than 1.5 times, greater than 2 times, or greater than 2.5 times the covered portion length. Further, prongs 65 may have an axial hole extending through the prong along its length, where the inner diameter of the axial hole is greater than an outer diameter of the portion of the pivotal comb tooth 62 disposed therein by an amount sufficient to allow movement of the pivotal comb tooth 62 within the prong 65. For example, a prong inner diameter may be greater than an outer diameter of a pivotal comb tooth shaft, creating an annular space or gap between the prong inner diameter and the shaft outer diameter. The thickness of the annular space may vary depending on, for example, the height of the prong and the amount of desired movement of the pivotal comb tooth within the prong.

One or more prongs may be integrally formed with the comb tooth bar, such as shown in FIGS. 6 and 7, or prongs may be attached to a comb tooth bar, e.g., by a threaded connection or by interlocking features. For example, in some embodiments, a prong may have a tubular body with an outer diameter less than a diameter of a comb tooth bar opening and a base with a diameter greater than the opening, where the tubular body may extend through the opening and radially outward from the comb tooth bar, and the base may be disposed within an interior portion of the comb tooth bar to retain the prong to the comb tooth bar. A comb tooth may further be disposed through an axial hole extending through the prong, where the inserted portion of the comb tooth is disposed in the interior portion of the comb tooth bar, the prong base is disposed between the inserted portion and a top wall of the comb tooth bar interior portion, and an exposed portion of the comb tooth extends radially outward from the prong tubular body. Prongs and associated comb tooth bars may be formed of a metal or other heat transferring material to provide increased heating surface area, which may result in tighter curls and improved hair curler performance.

Figure 8:
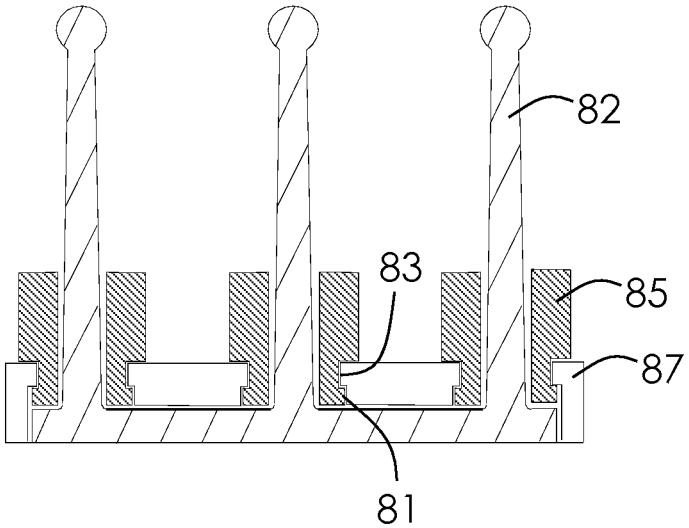
FIG. 8 shows a cross section view of a comb tooth assembly according to embodiments of the present disclosure along an axial direction.

FIG. 8 shows a cross sectional view (in a lengthwise direction) of an example of an embodiment having prongs 85 attached to a comb tooth bar 87, where pivotal comb teeth 82 may be disposed through the prongs 85 and retained by the comb tooth bar 87. The prongs 85 may be attached to openings in the comb tooth bar 87 using an interlocking configuration. The interlocking configuration may include a base 81 of each prong 85 having an outer diameter greater than a portion 83 axially above and adjacent to the base 81 and an upper portion of the opening having an inner diameter less than a lower portion of the opening, such that the outer profile of the base 81 and axially adjacent portion 83 of the prong 85 corresponds with the inner profile of the upper and lower portions of the opening, thereby retaining the base 81 of the prong to the comb tooth bar 87. In the embodiment shown, prongs 85 include a retention end (inserted into the opening of the comb tooth bar 87) and an exposed end (which may contact and heat hair), where the retention end has a tongue and groove type interlocking configuration. The tongue and groove type interlocking configuration may include serrations or cuts around its circumference to allow radial compression of the retention end during pushing the retention end into the opening. Further, prongs may have a constant inner diameter along its length, such as shown in FIG. 8, or prongs may have a gradually increasing inner diameter along its length from its base to the top of its exposed end, which may allow for greater movement of a pivotal comb tooth therein.

According to embodiments of the present disclosure, the outer diameter of a prong retention end (measured along the entire length or along a partial length of the retention end) may be less than the outer diameter of prong exposed end (measured along the entire length or along a partial length of the exposed end), such that the exposed end of the prong may extend radially outward from its central axis farther than all or a portion of the retention end. By having a prong outer profile with an exposed end extending radially farther than a retention end, a relatively larger interfacing surface area between the exposed end and an outer surface of the comb tooth bar may be provided, which may reduce relative movement between the prong and the comb tooth bar. For example, the embodiment shown in FIG. 8 shows a prong with an outer profile having an exposed end extend radially farther from its central axis than its retention end. As shown, the retention end (including the base 81 and axially adjacent portion 83) may have outer diameters less than the outer diameter of the exposed end of the prong 87. In some embodiments, a retention end may include a threaded interlocking configuration, which may be threaded into a correspondingly threaded opening in a comb tooth bar, where the retention end may have an outer diameter (measured along the entire length or along a partial length of the retention end) less than the outer diameter of its exposed end. In some embodiments, a prong may have a retention end with a tubular shape (without interlocking features), where the outer diameter of the retention end is less than the outer diameter of the exposed end. In such embodiments, the retention end may be attached to an opening of a comb tooth bar, for example, by interference fit, tack welding, or adhesive.

According to some embodiments, a hair curler may include a plurality of pivotable comb teeth pivotally retained to the outer surface of the hair curler without the use of a comb tooth bar. In such embodiments, cavities formed within the thickness of a metal sleeve (a depth below the metal sleeve outer surface) may form the recess in which an inserted portion of a comb tooth is retained, rather than the recess being formed between a comb tooth bar interior portion assembled to a linear groove, as discussed in other embodiments herein. Further, in such embodiments, prongs may or may not be provided around one or more of the pivotable comb teeth. Embodiments having prongs provided around one or more pivotable comb teeth may be integrally formed with an outer metal sleeve of the hair curler, or may be attached to openings formed in an outer metal sleeve of the hair curler.

Figure 9:
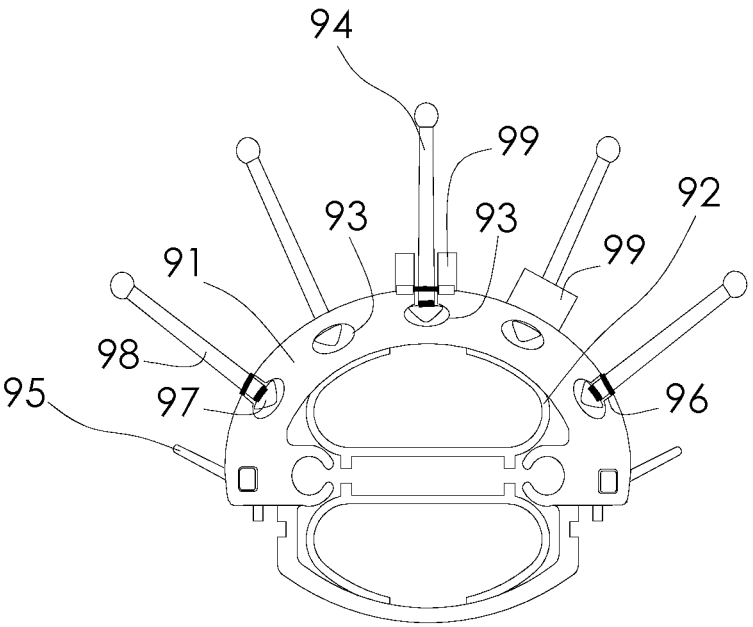
FIG. 9 shows a structural schematic diagram of a hair curler according to embodiments of the present disclosure.

For example, FIG. 9 shows a cross sectional view of a hair curler (viewed transverse to the longitudinal axis of the hair curler) having a plurality of pivotable comb teeth pivotally retained to the outer surface of the hair curler without the use of a comb tooth bar. The hair curler has a metal sleeve 91 disposed around a heating body 92, where pivotable comb teeth 94 are pivotably retained to the metal sleeve 91. The metal sleeve 91 may be formed as a single integral piece having one or more cavities 93 formed within the thickness of the metal sleeve 91. The cavities 93 may be formed below the outer surface of the metal sleeve 91 and extend a length (either a partial length or an entire length) of the metal sleeve 91. Cavities 93 may be formed in the metal sleeve 91, for example, by machining or drilling, or during molding in embodiments where the metal sleeve is formed by molding. One or more openings 96 may extend from the metal sleeve outer surface to cavities 93, such that access to the cavities 93 is provided via the openings 96. As shown, the inner diameter of each cavity 93 is larger than the inner diameter of the openings 96.

Pivotal comb teeth 94 include an inserted portion 97 and a shaft 98 extending from the inserted portion 97. The inserted portion 97 has a diameter larger than the diameter of an adjacent portion of the shaft 98, such that a stepped profile is formed between the shaft 98 and the inserted portion 97. An inserted portion 97 may be inserted through an opening 96 and into a cavity 93, where the inserted portion compresses through the opening 96 and returns to uncompressed form once in the cavity 93, thereby retaining the pivotal comb tooth 94 to the metal sleeve 91. The diameter of the inserted portion 97 in uncompressed form is larger than the inner diameter of the opening 96, such that the stepped profile of the pivotal comb tooth 94 inhibits the pivotal comb tooth 94 from being pulled out of the opening 96. Further, the outer profile of the inserted portion 97 may be smaller and/or have a different shape than the inner profile of the cavity 93 in which it is disposed, such that the inserted portion 97 may pivot or move relative to the cavity 93. The diameter of the shaft 98 is less than the inner diameter of the opening 96, such that the pivotal comb tooth 94 may pivot or move relative to the metal sleeve outer surface along with movement of the inserted portion 97 within the cavity 93. The degree of movement of a pivotal comb tooth 94 relative to the metal sleeve outer surface immediately surrounding the pivotal comb tooth 94 may vary depending on, for example, the difference between the inner diameter of the opening 96 and diameter of the shaft 98 and the depth the opening 96 extends from the outer surface to the cavity 93. According to some embodiments, the degree of movement of a pivotal comb tooth relative to the metal sleeve outer surface immediately surrounding the pivotal comb tooth may range from about 2 degrees to about 20 degrees.

The embodiment shown in FIG. 9 further includes fixed comb teeth 95 retained in cavities formed through the metal sleeve 91. The fixed comb teeth 95 may be fixedly retained to the metal sleeve 91 by forming correspondingly shaped inserted portions and cavities. For example, in the embodiment shown, an inserted portion of a fixed comb tooth 95 may have a generally rectangular outer profile, and the cavity in which the inserted portion is disposed may have a correspondingly shaped rectangular inner profile, such that when the fixed comb tooth inserted portion is inserted into the cavity, the mating profiles retain and hold in position the fixed comb tooth 95.

Further, as shown in FIG. 9, pivotal comb teeth may be pivotally retained to a metal sleeve with or without the use of prongs 99. In embodiments having a metal sleeve 91 formed as a single piece, one or more prongs 99 may be integrally formed together with the metal sleeve 91. However, in some embodiments, one or more prongs may be attached to a single piece metal sleeve.

By forming a metal sleeve as a single piece and retaining one or more comb teeth thereto via openings extending to cavities beneath the metal sleeve's outer surface (without the use of a comb tooth bar), a relatively greater heat transferring surface area may be provided, which may improve heating and curling of a user's hair. Further, by integrally forming one or more prongs with a metal sleeve, seams between assembled together components may be reduced and a smoother heat transferring surface may be provided, which may reduce the likelihood of hair getting caught in seams.

Selected embodiments are described above in detail with reference to the accompanying figures. However, various features of the described embodiments may be combined or removed as desired to form hair curlers to provide different benefits such as, for example, improved hair heating, easier or cheaper manufacturing, and/or reduction in hair getting stuck during use. For example, according to embodiments of the present disclosure, a hair curler may include a metal sleeve disposed around a heating body and a plurality of comb teeth retained to the metal sleeve, without the use of prongs disposed around a portion of the comb teeth shafts, where the inserted portions of multiple comb teeth are integrally formed together. In some embodiments, a hair curler may include a metal sleeve disposed around a heating body and a plurality of comb teeth having integrally formed together inserted portions that are retained to the metal sleeve, where one or more prongs having a narrower retention end than exposed end may be attached to the metal sleeve by mechanical attachment, welding, or adhesives. Other combinations of hair curler features described herein may be selected to design and form a hair curler.

As referenced in the background section, conventional hair curlers include those without comb teeth and those with comb teeth fixed in a stationary position to the hair curler (having a fixed connection to the hair curler). However, comb teeth fixed to a hair curler may result in a user's hair getting pulled or stuck during use of the hair curler, making the fixed tooth hair curler uncomfortable and/or inconvenient to use.

In view of the shortcomings of previously known hair curlers, the following technical solution may be utilized: Embodiments of the present disclosure may include providing a hair curler with swinging or pivotable comb teeth, where the pivotal comb teeth are movable relative to the hair curler, so that the hair curler is more convenient to use and simple in structure.

In hair curlers with pivotable comb teeth according to embodiments of the present disclosure, a comb tooth assembly may be provided on a curling iron assembly such that the hair of a user can be combed during the hair curling process and thereby the hair curling effect is better. Meanwhile, as the pivotable comb teeth are capable of sliding or pivoting relative to the comb tooth bars to which the pivotable comb teeth are retained, the comb tooth assembly may have certain flexibility during the hair curling process, so that the situations where hair is snapped, strained or the like during the hair curling process can be effectively mitigated, and the hair curler is more comfortable in use and simple in structure.

Various other corresponding alterations and modifications can be made for those skilled in the art according to the above-described technical solutions and conceptions, and all these alterations and modifications shall fall into the protection scope of the claims of the present invention

What is claimed is:

1. A hair curler, comprising:

a curling iron assembly, comprising:

a heating body;

a metal sleeve disposed around the heating body, the metal sleeve comprising a first linear groove, a second linear groove and a third linear groove formed in an outer surface of the metal sleeve;

a first comb tooth assembly arranged on the curling iron assembly, the first comb tooth assembly comprising:

a comb tooth bar disposed within the first linear groove;

a recess formed between a bottom wall of the first linear groove and an interior portion of the comb tooth bar; and a plurality of pivotable comb teeth, each of the plurality of pivotable comb teeth comprising an inserted portion pivotally retained within the recess and movable relative to the comb tooth bar;

a second comb tooth assembly comprising a fixed comb tooth retained to the second linear groove; and a third comb tooth assembly comprising a fixed comb tooth retained to the third linear groove, wherein the second linear groove and the third linear groove are located on opposite sides of the metal sleeve; and a hand grip fixed to the curling iron assembly in an end-to-end configuration.

2. The hair curler of claim 1, wherein the inserted portion has a volume less than the recess.

3. The hair curler of claim 1, wherein the inserted portion comprises an arcuate cross sectional profile pivotable about the bottom wall of the first linear groove.

4. The hair curler of claim 1, wherein the first linear groove has an interior cross sectional profile comprising a first inner diameter smaller than a second inner diameter, the first inner diameter proximate the outer surface of the metal sleeve and the second inner diameter proximate the bottom wall, and wherein the comb tooth bar has an outer cross sectional profile comprising a first outer diameter smaller than a second outer diameter, the portion of the comb tooth bar having the second outer diameter retained within the linear groove by the portion of the first linear groove having the first inner diameter.

5. The hair curler claim 1, wherein the metal sleeve comprises aluminum.

6. The hair curler of claim 1, further comprising at least one prong having a retention end inserted into and attached to an opening of the recess and an exposed end encompassing a portion of one of the pivotal comb teeth, wherein an outer diameter of the exposed end is greater than an outer diameter of the retention end.

7. The hair curler of claim 1, wherein the hair curler comprises a plurality of first comb tooth assemblies, each of the plurality of first comb tooth assemblies circumferentially spaced between the second comb tooth assembly and the third comb tooth assembly.

8. The hair curler of claim 1, further comprising a plurality of heating guards axially spaced apart along the length of the curling iron assembly, extending along the circumference of the curling iron assembly between the second comb tooth assembly and the third comb tooth assembly on a surface of the curling iron assembly opposite the first comb tooth assembly, and extending radially outward from the surface of the curling iron assembly.

9. A hair curler, comprising:

a curling iron assembly, comprising:

a heating body; and a metal sleeve disposed around the heating body;

a plurality of openings formed in an outer surface of the metal sleeve and a plurality of recesses formed a depth beneath the outer surface, each one of the plurality of openings extending to a separate recess of the plurality of recesses; and a plurality of comb teeth extending outwardly from the curling iron assembly, the comb teeth comprising:

a plurality of a first type of comb tooth, each having a first type inserted portion pivotably retained within a separate recess of the plurality of recesses beneath the outer surface; and a plurality of a second type of comb tooth, having a second type inserted portion fixedly retained within and having a mating shape with a separate recess of the plurality of recesses beneath the outer surface, wherein the openings are spaced axially along a length of the curling iron assembly and are spaced circumferentially around a portion of the outer surface extending less than an entire perimeter of the curling iron assembly, and wherein at least one intermediate axial row of openings is spaced circumferentially between two border axial rows of openings, wherein the plurality of the first type of comb tooth are retained to the intermediate axial row of openings, and the plurality of the second type of comb tooth are retained to the border axial rows of openings; and a hand grip fixed to the curling iron assembly in an end-to-end configuration.

10. The hair curler of claim 9, wherein each first type inserted portion has a cross sectional profile shape different from a cross sectional profile shape of the recess.

11. The hair curler of claim 9, wherein each first type inserted portion has a semicircular cross sectional profile and the recess has a polygonal cross sectional profile.

12. The hair curler of claim 9, wherein the first type of comb tooth further comprises a shaft extending outwardly from the inserted portion to a ball tip at an axial end of the comb tooth opposite the inserted portion, the ball tip having a diameter greater than the shaft.

13. The hair curler of claim 9, wherein the metal sleeve comprises aluminum.

14. The hair curler of claim 9, wherein each of the plurality of the first type of comb tooth is pivotable by 2 to 20 degrees relative to the outer surface of the metal sleeve.

* * * * *